US012351412B2

(12) United States Patent
Nakagaki et al.

(10) Patent No.: US 12,351,412 B2
(45) Date of Patent: Jul. 8, 2025

(54) CONVEYANCE APPARATUS AND PRINTING APPARATUS

(71) Applicants: Toshihiro Nakagaki, Ibaraki (JP); Kohei Chike, Tokyo (JP)

(72) Inventors: Toshihiro Nakagaki, Ibaraki (JP); Kohei Chike, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 125 days.

(21) Appl. No.: 17/969,117

(22) Filed: Oct. 19, 2022

(65) Prior Publication Data

US 2023/0131241 A1 Apr. 27, 2023

(30) Foreign Application Priority Data

Oct. 27, 2021 (JP) ..... 2021-175993

(51) Int. Cl.
*B65H 29/58* (2006.01)
*B65H 5/02* (2006.01)
*B65H 7/02* (2006.01)

(52) U.S. Cl.
CPC ..... *B65H 29/58* (2013.01); *B65H 5/021* (2013.01); *B65H 7/02* (2013.01); *B65H 2801/21* (2013.01)

(58) Field of Classification Search
CPC ..... B65H 7/06; B65H 29/62
See application file for complete search history.

(56) References Cited

U.S. PATENT DOCUMENTS

| | | | | |
|---|---|---|---|---|
| 11,186,095 | B2 * | 11/2021 | Aihara | B41J 2/325 |
| 2012/0074638 | A1 | 3/2012 | Nakagaki | |
| 2013/0241146 | A1 | 9/2013 | Takai et al. | |
| 2013/0320616 | A1 | 12/2013 | Nakagaki | |
| 2014/0327207 | A1 * | 11/2014 | Nakagaki | B65H 5/021 271/262 |
| 2016/0114993 | A1 | 4/2016 | Nakagaki | |
| 2016/0152431 | A1 | 6/2016 | Maeda et al. | |
| 2018/0170077 | A1 * | 6/2018 | Nistor | G03G 15/5062 |
| 2020/0398515 | A1 * | 12/2020 | Fornos Jove | B65H 29/58 |
| 2021/0163250 | A1 | 6/2021 | Nakagaki | |
| 2022/0162030 | A1 | 5/2022 | Chike et al. | |

FOREIGN PATENT DOCUMENTS

| | | |
|---|---|---|
| JP | 200312214 A | 1/2003 |
| JP | 2020-142427 | 9/2020 |
| JP | 2021-091547 | 6/2021 |

OTHER PUBLICATIONS

Japanese Office Action issued May 7, 2025 in Japanese Patent Application No. 2021-175993.

* cited by examiner

*Primary Examiner* — Howard J Sanders
(74) *Attorney, Agent, or Firm* — Harness, Dickey & Pierce, P.L.C.

(57) ABSTRACT

A conveyance apparatus includes a conveyor and processing circuitry. The conveyor conveys a sheet. The processing circuitry controls conveyance of the sheet by the conveyor and switching a direction in which the conveyor conveys the sheet to a direction opposite to a direction in which the sheet is ejected, after the conveyance of the sheet is stopped under a predetermined condition.

10 Claims, 14 Drawing Sheets

| FIG. 14A |
| --- |
| FIG. 14B |

CONVEYANCE APPARATUS AND PRINTING APPARATUS

CROSS-REFERENCE TO RELATED APPLICATIONS

This patent application is based on and claims priority pursuant to 35 U.S.C. § 119(a) to Japanese Patent Application No. 2021-175993, filed on Oct. 27, 2021, in the Japan Patent Office, the entire disclosure of which is hereby incorporated by reference herein.

BACKGROUND

Technical Field

Embodiments of the present disclosure relate to a conveyance apparatus and a printing apparatus.

Related Art

An apparatus is known that conveys a sheet in the art. In such an apparatus, a conveyance failure may occur when floating, wrinkling, or folding of the sheet occurs. For this reason, an apparatus stops conveyance of a sheet when a conveyance failure such as floating, wrinkling, or folding of the sheet material occurs and ejects a subsequent sheet to a predetermined purging tray.

An image forming apparatus includes a first conveyance path through which a sheet is conveyed, a second conveyance path through which the sheet is conveyed to a tray for purging, and a switcher for switching between the first conveyance path and the second conveyance path upstream from a conveyance failure detector when a conveyance failure is detected.

SUMMARY

In an embodiment of the present disclosure, a conveyance apparatus includes a conveyor and processing circuitry. The conveyor conveys a sheet. The processing circuitry controls conveyance of the sheet by the conveyor and switching a direction in which the conveyor conveys the sheet to a direction opposite to a direction in which the sheet is ejected, after the conveyance of the sheet is stopped under a predetermined condition.

In another embodiment of the present disclosure, a printing apparatus includes an image forming device and the conveyance apparatus. The image forming device prints the sheet.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
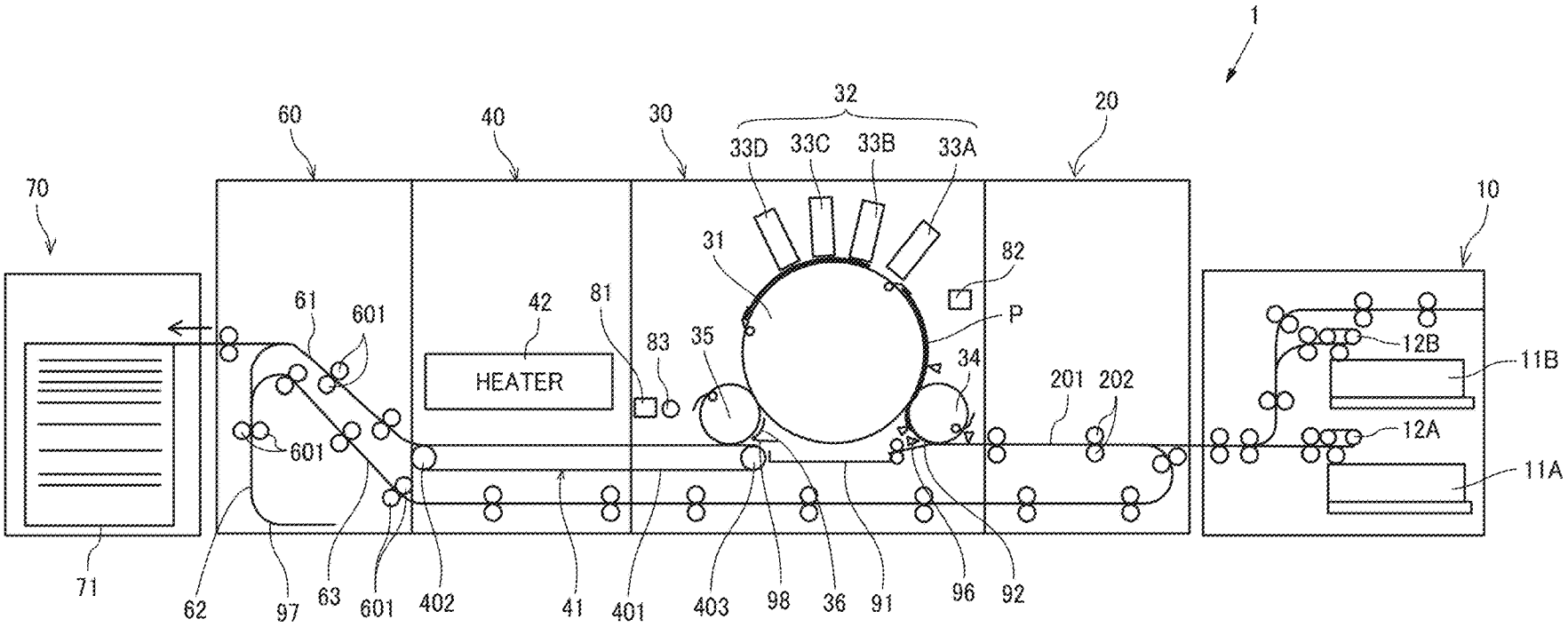
FIG. 1 is a schematic diagram illustrating a printing apparatus according to a first embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Figure 2:
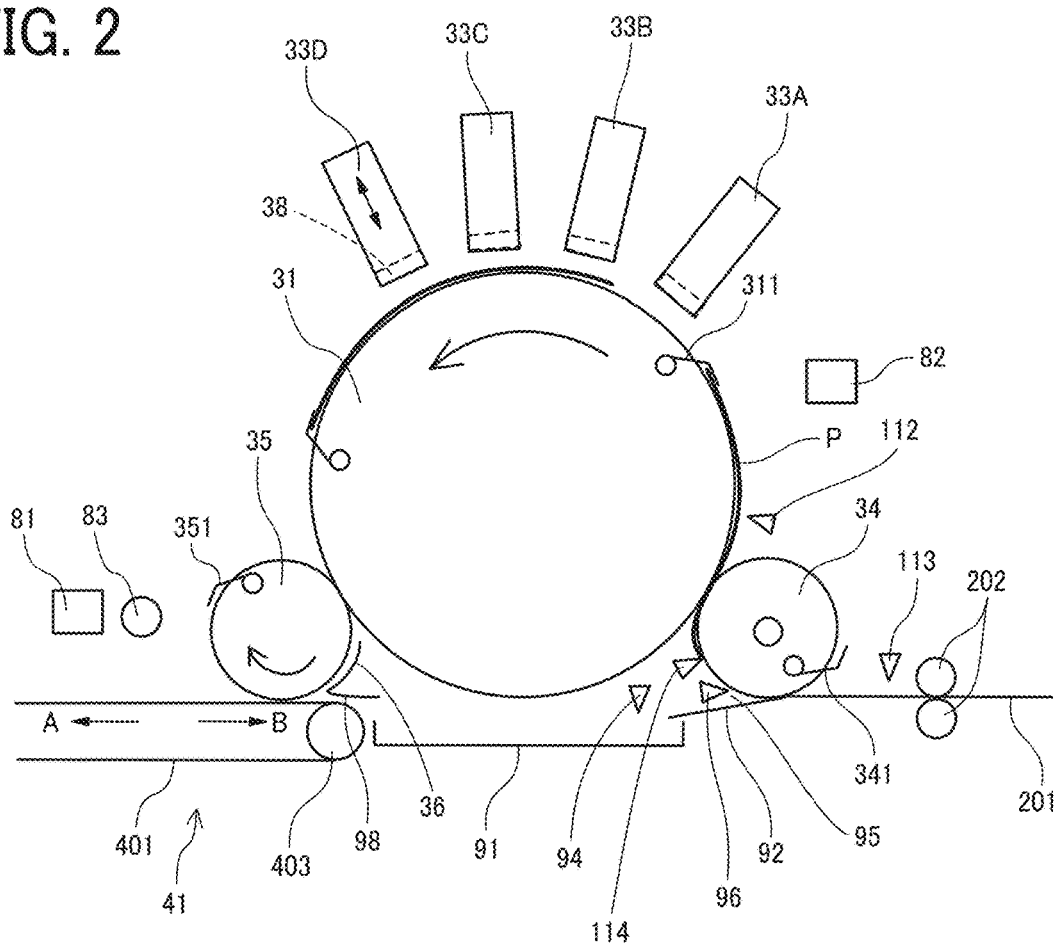
FIG. 2 is an enlarged view of a drum and the periphery of the drum, according to the first embodiment of the present disclosure.
Figure 3:
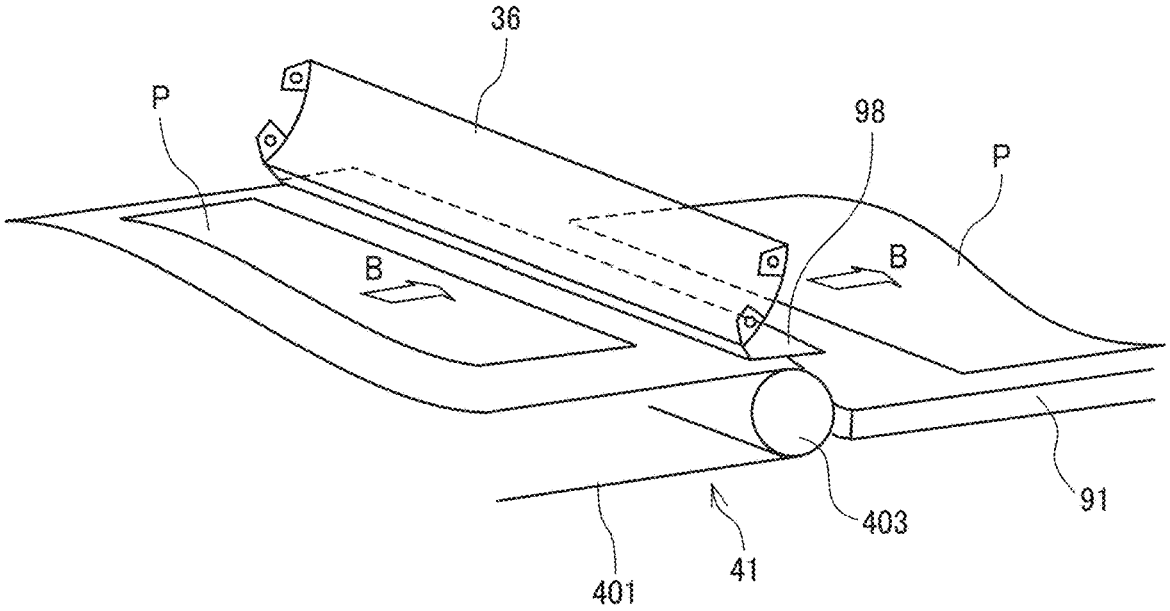
FIG. 3 is a perspective view of the vicinity of an exit rotator according to the first embodiment of the present disclosure.

Embodiments of the present disclosure are described with reference to the attached drawings in the following description. A printing apparatus according to a first embodiment of the present disclosure is described with reference to FIGS. 1, 2 and 3. FIG. 1 is a schematic diagram illustrating a printing apparatus 1 according to the first embodiment. FIG. 2 is an enlarged view of a drum 31 and the periphery of the drum 31, according to the first embodiment. FIG. 3 is a perspective view of an exit rotator 35 and the periphery of the exit rotator 35, according to the first embodiment.

The printing apparatus 1 as a printing system includes a sheet feeder 10 that carries in a sheet P, a sheet receiver 20, a printer 30 serving as an image forming device, a drier 40, a reversing mechanism 60, and a sheet stacker 70.

The printing apparatus 1 receives the sheet P conveyed and supplied from the sheet feeder 10 in the sheet receiver 20, applies liquid in the printer 30 to perform printing as desired, dries and fixes the liquid attached to the sheet P in the drier 40, and then ejects the sheet P to the sheet stacker 70.

The sheet feeder 10 includes a lower loading tray 11A and an upper loading tray 11B that accommodate multiple sheets P. The sheet feeder 10 also includes a feeding device 12A and a feeding device 12B that separate and feed out the sheets P one by one from the lower loading tray 11A and the upper loading tray 11B, respectively, and supply the sheets P to the sheet receiver 20.

The printer 30 includes the drum 31 that is a rotating carrier that rotates while carrying the sheet P received by the sheet receiver 20 on a circumferential surface of the drum 31, and a liquid discharger 32 that discharges liquid toward a sheet P borne by the drum 31.

Further, the printer 30 includes an entrance rotator 34 that receives the sheet P fed from upstream in a conveyance direction and delivers the sheet P to the drum 31, and an exit rotator 35 that receives the sheet P conveyed by the drum 31 and delivers the sheet P to the drier 40.

The sheet P is conveyed by, for example, a conveyance roller pair 202 on a feed path 201 of the sheet receiver 20 disposed upstream in the conveyance direction. Then, the entrance rotator 34 grips a leading end of the sheet P at a receiving position with a gripper 341 which is a sheet gripper disposed on an outer peripheral portion of the entrance rotator 34 to receive the sheet P.

The sheet P is conveyed by the rotation of the entrance rotator 34, and the conveyed sheet P is delivered to the drum 31 at a position facing the drum 31.

In the present embodiment, when the sheet P is conveyed on the feed path 201, the conveyance speed is adjusted by the conveyance roller pair 202, and the timing at which the leading end of the sheet P is gripped by the gripper 341 of the entrance rotator 34 is adjusted. The sheet P is conveyed to a receiving position while the inclination of the sheet P against a direction orthogonal to the conveyance direction of the sheet P and a conveyance position of the sheet P are corrected by a skew detector and a correction device.

In the feed path 201, a width detector that detects the width of the sheet P and a length detector that detects the length of the sheet P are arranged. Accordingly, when measured values are different from set sheet-size values, a printing operation is stopped and the liquid is prevented from being discharged onto the drum 31.

Grippers 311 that serve as sheet grippers are also disposed on the surface of the drum 31, and the leading end of the sheet P is gripped by one of the grippers 311. The drum 31 includes multiple suction holes dispersedly formed on the surface of the drum 31, and a suction device generates suction airflows directed inward of the drum 31 from the suction holes of the drum 31.

The leading end of the sheet P delivered from the entrance rotator 34 to the drum 31 is gripped by one of the grippers 311, is attracted by the suction airflows blown by the suction device onto the circumferential surface of the drum 31, and the sheet P is conveyed while the drum 31 rotates.

The liquid discharger 32 includes discharge units 33A, 33B, 33C, and 33D to discharge liquid. Each of the discharge units 33A, 33B, 33C, and 33D includes a liquid discharge head as a liquid discharger. For example, the discharge unit 33A discharges liquid of cyan (C), the discharge unit 33B discharges liquid of magenta (M), the discharge unit 33C discharges liquid of yellow (Y), and the discharge unit 33D discharges liquid of black (K). In addition, a discharge unit to discharge a special liquid, in other words, liquid of spot color such as white, gold, or silver, can be used.

Note that as illustrated in FIG. 2, in the printer 30, each of the discharge units 33A, 33B, 33C, and 33D includes a cap 38 that caps a discharge surface, i.e., a nozzle surface, of corresponding one of the discharge units 33A, 33B, 33C, and 33D of the liquid discharger 32. The discharge units 33A, 33B, 33C, and 33D are disposed to reciprocate in a direction indicated by a bidirectional arrow in FIG. 2, and each of the caps 38 is disposed in corresponding one of the discharge units 33A, 33B, 33C, and 33D to be movable in an axial direction of the drum 31. When the cap 38 caps the discharge surface of corresponding one of the discharge units 33A, 33B, 33C, and 33D, the corresponding one of the discharge units 33A, 33B, 33C, and 33D moves in a direction away from the circumferential surface of the drum 31, and the cap 38 enters below the corresponding one of the discharge units 33A, 33B, 33C, and 33D to cap the discharge surface.

The discharge operation of each of the discharge units 33A, 33B, 33C, and 33D of the liquid discharger 32 is controlled by drive signals corresponding to print data. When the sheet P borne on the drum 31 passes through a position facing the liquid discharger 32, the liquids of respective colors are discharged from the discharge units 33A, 33B, 33C, and 33D toward the sheet P, and an image corresponding to the print data is formed and printed on the sheet P.

In the present embodiment, an example in which the printer 30 includes the liquid discharger 32 has been described. However, printing may be performed by any other method such as an electrophotographic method than the liquid discharge method.

The sheet P on which the image has been formed is delivered from the drum 31 to the exit rotator 35. The exit rotator 35 receives the sheet P delivered from the drum 31, with a gripper 351 being a sheet gripper disposed on an outer circumferential surface of the exit rotator 35. Then, the sheet P is delivered to a conveyor 41 of the drier 40 by the rotation of the exit rotator 35.

A guiding member 36 is disposed along the circumferential surface of the exit rotator 35. The guiding member 36 guides the sheet P delivered from the drum 31 to a conveyance belt 401 of the conveyor 41 by the exit rotator 35

The drier 40 includes the conveyor 41 that conveys the sheet P delivered from the exit rotator 35, and a heater 42 that heats the sheet P conveyed by the conveyor 41. The conveyor 41 includes the endless conveyance belt 401, and a driving roller 402 and a driven roller 403 around which the conveyance belt 401 is wound. The conveyance belt 401 can be rotationally moved in forward and reverse directions by rotationally driving the driving roller 402 in forward and reverse directions.

The drier 40 dries the liquid that has been applied onto the sheet P in the printer 30. Accordingly, a liquid component such as moisture in the liquid evaporates, and colorants contained in the liquid are fixed onto the sheet P. Additionally, curling of the sheet P is reduced. The sheet P that has passed through the drier 40 is conveyed to the reversing mechanism 60.

The reversing mechanism 60 includes an ejection path 61 on which the sheet P is conveyed from the drier 40, and a reverse path 62 and a duplex path 63 that are used when printing is performed on both sides of the sheet P. Note that the reverse path 62 also includes a reverse purge tray 97 onto which the sheet P is purged.

The reverse path 62 receives the sheet P from the ejection path 61, reverses front and back sides of the sheet P, and sends the sheet P to the duplex path 63. The duplex path 63 is disposed extending below the drier 40 and the printer 30 and feeds the sheet P reversed in the reverse path 62 to the feed path 201 of the sheet receiver 20 again. One or multiple conveyance roller pairs 601 are disposed in the ejection path 61, the reverse path 62, and the duplex path 63.

The sheet stacker 70 includes an output tray 71 on which multiple sheets P are stacked. Each of the sheets P that are conveyed from the reversing mechanism 60 is sequentially stacked and held on the output tray 71.

Next, a configuration of components related to a sheet purge operation in the present embodiment is described.

In the present embodiment, a conveyance drive source disposed in the drum 31 that serves as a rotating carrier is used to connect the entrance rotator 34 and the exit rotator 35 to the conveyance drive source with gears. Accordingly, the drum 31, the entrance rotator 34, and the exit rotator 35 are driven in conjunction with each other to convey the sheet P. However, each of the entrance rotator 34, the drum 31, and the exit rotator 35 may be driven by an individual drive source.

In the printing apparatus 1 of the present embodiment, the entrance rotator 34 and the exit rotator 35 of the printer 30 and the conveyor 41 of the drier 40 collectively serve as a conveyance apparatus according to embodiments of the present disclosure.

The conveyance drive source disposed in the drum 31 can be independently driven by the operation of an inching switch 81. Accordingly, even when the printing apparatus 1 is stopped, the entrance rotator 34, the drum 31, and the exit rotator 35 can be rotationally driven as an inching operation by a manual operation of the inching switch 81, and a sheet P that remains stopped can be ejected.

Note that the inching operation is an operation in which the rotation speed of the drum 31 is lower than the rotation speed during the printing operation only when the inching switch 81 is pressed, and the rotation of the drum 31 is stopped when the inching switch 81 is released. A sheet P that remains on the drum 31 is removed by an operation of the inching switch 81 by a user. Note that the inching operation may be performed automatically.

Below the drum 31, a purge tray 91 that serves as a storage of purged sheets P is disposed between the entrance rotator 34 and the exit rotator 35.

A purge path 92 is disposed on an extension of the feed path 201. The purge path 92 extends obliquely downward from a receiving position at which the entrance rotator 34 receives the sheet P from the feed path 201. A purge ejection sensor 94 that detects the sheet P is disposed above the purge tray 91 and detects that the sheet P to be purged has been ejected to the purge tray 91.

Further, a position downstream from the receiving position at which the entrance rotator 34 receives the sheet P is set as a switcher 95 that switches the feed path of the sheet P. A branching claw 96 is disposed in the switcher 95.

A purge switch 82 (see FIGS. 1, 2, 6) that instructs, for example, ejection of the sheet P to the purge tray 91 is disposed in the printer 30.

A conveyance failure detector 112 that detects a position shift of the sheet Pin a thickness direction of the sheet P on the circumferential surface of the drum 31 is disposed in the vicinity of a position at which the drum 31 receives the sheet P from the entrance rotator 34. The conveyance failure detector 112 detects conveyance failures such as edge folding, floating, and wrinkling of the sheet P. Note that the conveyance failure described in the present embodiment is not a state in which conveyance of the sheet P is actually disabled, but is a state in which a sheet P is likely to cause a conveyance failure.

In other words, if the surface of the sheet P is inclined when the sheet P is sucked onto the drum 31, the leading end of the sheet P may be detached from the gripper 311 and folded, or the sheet P may be floated, or wrinkled. In such a state as described above, when the sheet P enters a gap between the circumferential surface of the drum 31 and the heads of the discharge units 33A, 33B, 33C, and 33D, the heads of the discharge units 33A, 33B, 33C, and 33D may be damaged due to interference between the sheet P and the discharge units 33A, 33B, 33C, and 33D.

For this reason, when a conveyance failure is detected by the conveyance failure detector 112, the conveyance drive of the sheet P is stopped before the sheet P enters the gap between the circumferential surface of the drum 31 and the head of the discharge unit 33A disposed most upstream in the conveyance direction.

Further, a first sensor 113 and a second sensor 114 that serve as sheet detectors to detect the presence or absence of the sheet P at a position of the switcher 95 are disposed.

The first sensor 113 is disposed upstream from the switcher 95 in the conveyance direction. In the present embodiment, the first sensor 113 is disposed at a position upstream from the entrance rotator 34, at which the first sensor 113 can detect the presence or absence of the sheet P on the feed path 201.

The second sensor 114 is disposed downstream from the switcher 95 in the conveyance direction. In the present embodiment, the second sensor 114 is disposed at a position at which the second sensor 114 can detect the presence or absence of the sheet P on the circumferential surface of the entrance rotator 34.

When both the first sensor 113 and the second sensor 114 detect the sheet P, the sheet P is present across the switcher 95. Based on the detection results of the first sensor 113 and the second sensor 114, control is performed such that the feed path can be switched from the drum 31 to the purge path 92 by the branching claw 96 in a state in which no sheet P is present across the switcher 95.

Next, a configuration of components in which the sheet P is conveyed in a direction opposite to a sheet ejection direction by the conveyor 41 is described with regard to FIG. 2.

When the conveyance of the sheet P is stopped under a predetermined condition, a conveyance controller 801 to be described later controls the conveyor 41 to switch the conveyance direction of the sheet P to a direction indicated by arrow B opposite to the sheet ejection direction indicated by arrow A.

In the present embodiment, as described above, the conveyor 41 is disposed downstream from the drum 31 which is a rotating carrier that rotates while carrying the sheet P. Below the drum 31, the purge tray 91 that serves as the storage to store sheets P to be conveyed in a direction opposite to the conveyance direction by the conveyor 41 is disposed.

As described above, the sheet P is conveyed in the direction indicated by the arrow B, opposite to the sheet ejection direction by the rotary movement of the conveyance belt 401 of the conveyor 41 in the reverse direction. Accordingly, the sheet P on the conveyance belt 401 is conveyed to and stored in the purge tray 91 that serves as the storage.

Note that a case in which the conveyance belt 401 circularly moves in the direction in which the sheet P is conveyed in the direction indicated by arrow A is also referred to as rotation driving in a forward direction, and a case in which the conveyance belt 401 circularly moves in the direction in which the sheet P is conveyed in the direction indicated by arrow B is also referred to as rotation driving in a reverse direction.

The purge tray 91 is disposed at a position at which the stored sheets P can be easily taken out of the printing apparatus 1. Such a configuration can facilitate an operation of removing the sheets P, shorten a tact time during which the printing apparatus 1 is stopped, and prevent a decrease in productivity.

In the vicinity of the conveyor 41, a belt reverse switch 83 is disposed as an instruction device that instructs the movement of the conveyance belt 401 in the reverse direction indicated by arrow B. In the conveyor 41, while the belt reverse switch 83 is pressed, the driving roller 402 is driven to rotate in reverse. Accordingly, the conveyance belt 401 is moved in the reverse direction, i.e., the direction of conveyance indicated by arrow B to convey the sheet P toward the purge tray 91.

Further, as illustrated in FIG. 3, a guide 98 is disposed as a guide that guides the sheet P to the purge tray 91 when the conveyance belt 401 is moved in the reverse direction to convey the sheet P in the direction indicated by arrow B opposite to the ejection direction indicated by arrow A.

Thus, when the conveyance belt 401 is moved in the direction indicated by arrow B to convey the sheet P to the purge tray 91, the sheet P is prevented from being reversely conveyed toward the exit rotator 35 or the drum 31.

Note that in the present embodiment, the guide 98 is integrated with the guiding member 36. However, the guide 98 and the guiding member 36 may be separate from each other.

Figure 4:
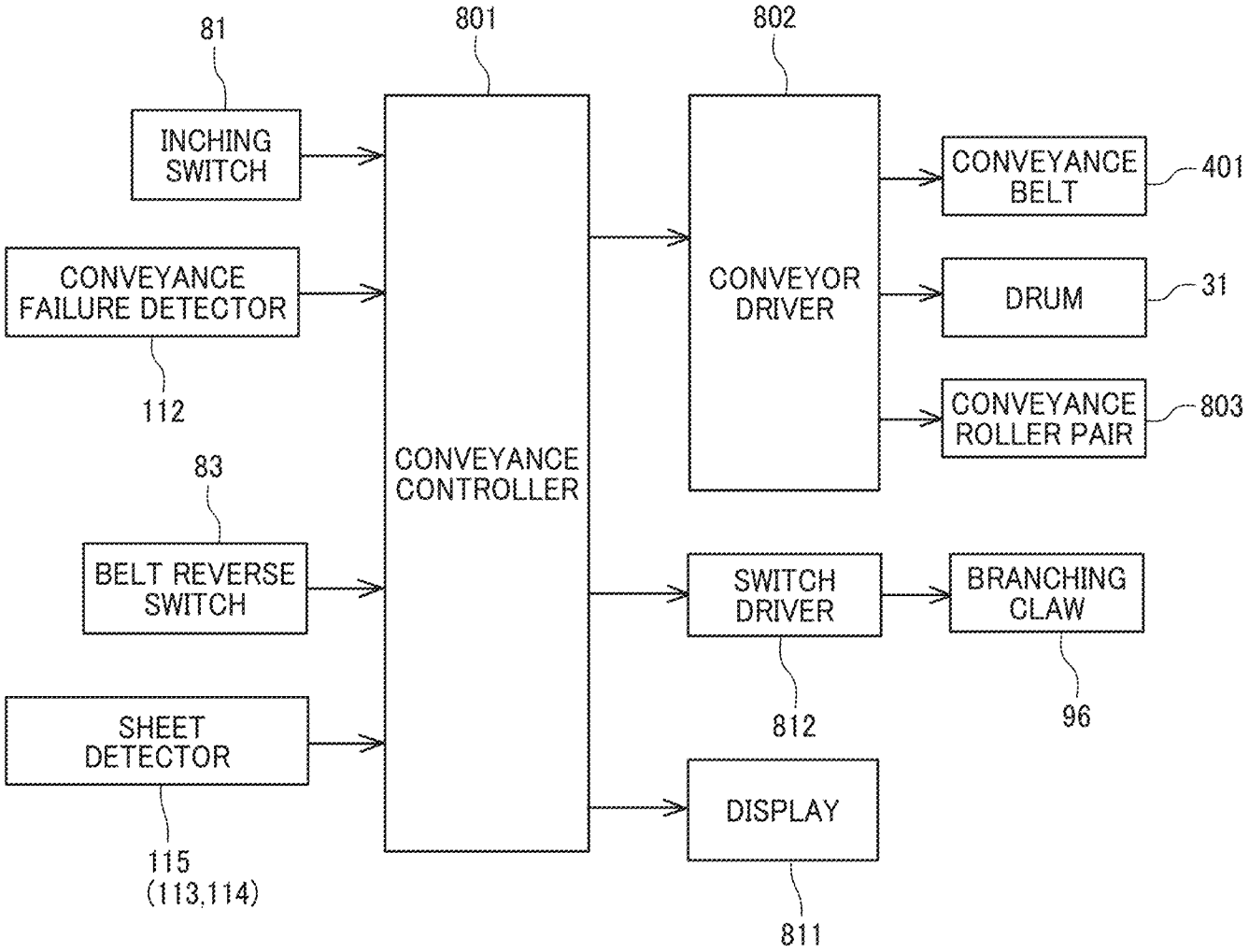
FIG. 4 is a block diagram illustrating components related to control of a sheet purge operation, according to the first embodiment of the present disclosure.

Next, control of the sheet purge operation is described with reference to a block diagram of FIG. 4, according to the present embodiment.

The conveyance controller 801 controls the conveyance operation under normal operating conditions and the conveyance operation in the sheet purge operation.

The conveyance controller 801 also serves as a controller that performs control to switch the direction in which the conveyor 41 conveys the sheet P to the direction indicated by arrow B opposite to the direction in which the sheet P is ejected, indicated by arrow A, when conveyance of the sheet P is stopped under a predetermined condition. Note that the direction in which the sheet P is ejected is a direction in which the sheet P moves toward the sheet stacker 70, and the above-described direction indicated by arrow B opposite to the direction in which the sheet P is ejected is a direction in which the sheet P moves toward the purge tray 91.

When the conveyance failure detector 112 detects a conveyance failure, the conveyance controller 801 stops the operations of the drum 31, the conveyance belt 401, and a conveyance roller pair group 803 including the conveyance roller pair 202 and the conveyance roller pair 601, via a conveyance system driver 802, to stop the conveyance operation.

When the inching operation is instructed by the inching switch 81, the conveyance controller 801 controls the inching operation for driving the drum 31 and the entrance rotator 34 and the exit rotator 35 moving together with the drum 31 via the conveyance system driver 802.

If a sheet detector 115, i.e., the first sensor 113 and the second sensor 114, detects that the sheet P is present across the switcher 95 when the sheet purge operation is instructed, the conveyance controller 801 displays a message that prompts to perform the inching operation on a display 811.

After the sheet detector 115 detects that there is no sheet P in the switcher 95 when the sheet purge operation is instructed, the conveyance controller 801 switches the branching claw 96 via a switching driver 812 such that the sheet P is conveyed to the purge path 92, and conveys the sheet P.

When a conveyance failure is detected and the conveyance operation is stopped, the conveyance controller 801 controls operations such as conveyance of the remaining sheets P to the sheet stacker 70, ejection of the sheets P to the reverse purge tray 97, and ejection of the sheets P to the purge tray 91 as desired.

When the belt reverse switch 83 is operated, the conveyance controller 801 moves the conveyance belt 401 of the conveyor 41 in the reverse direction, conveys the sheet P in the direction indicated by arrow B which is opposite to the sheet ejection direction, and sends the sheet P to the purge tray 91.

Figure 5A:
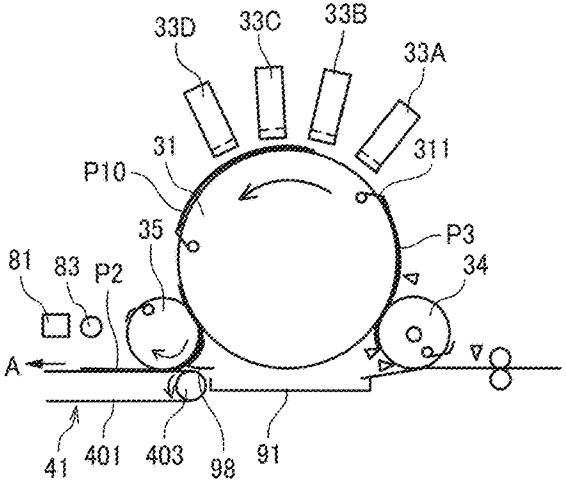
FIGS. 5A, 5B, and 5C are views of the drum of FIG. 2 and the periphery of the drum, illustrating an example of a procedure of removing sheets that remain stopped on the drum, according to the first embodiment of the present disclosure.
Figure 5B:
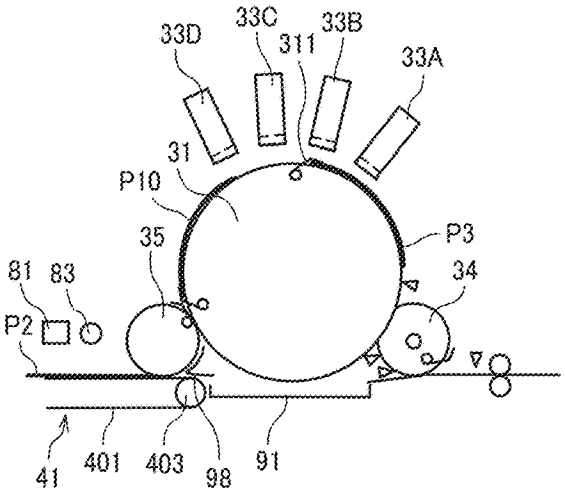
Figure 5C:
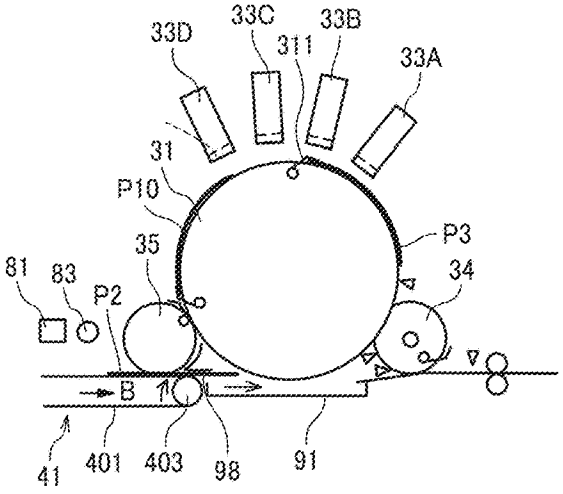

Next, an example of operation of removing the sheets P2, P10, and P3 that remain stopped on the drum 31 according to the first embodiment is described with reference to FIGS. 5A, 5B, and 5C. FIGS. 5A, 5B, and 5C are views of the drum 31 and the periphery of the drum 31, illustrating an example of a procedure of removing the sheets P2, P10, and P3 that remain stopped on the drum 31, according to the first embodiment of the present disclosure.

In the present embodiment, for example, when a conveyance failure is detected with the sheet P3 and conveyance of the sheets P2, P10, and P3 is stopped, the sheets P2, P10, and P3 remain stopped on the drum 31 in order from downstream to upstream in the conveyance direction.

First, as illustrated in FIG. 5A, the inching switch 81 is operated to perform the inching operation, and the sheet P2 is conveyed toward the conveyance belt 401 of the conveyor 41. Then, as illustrated in FIG. 5B, when the sheet P2 is sufficiently conveyed onto the conveyance belt 401, the inching operation is stopped.

Next, as illustrated in FIG. 5C, the belt reverse switch 83 is operated to rotate the conveyance belt 401 of the conveyor 41 in the direction opposite to the direction when the inching operation is performed to convey the sheet P2 in the direction indicated by arrow B opposite to the conveyance direction indicated by arrow A to eject the sheet P2 to the purge tray 91.

An operation similar to the above-described operation is repeated for the sheets P10 and P3 to sequentially convey the sheets P10 and P3 that remain stopped on the drum 31 to the purge tray 91.

Accordingly, the sheets P2, P10, and P3 that remain stopped in the printing apparatus 1 can be quickly transferred to the purge tray 91, by means of which the sheets P can be removed to the outside of the printing apparatus 1. Thus, a decrease in productivity can be reduced.

Figure 6:
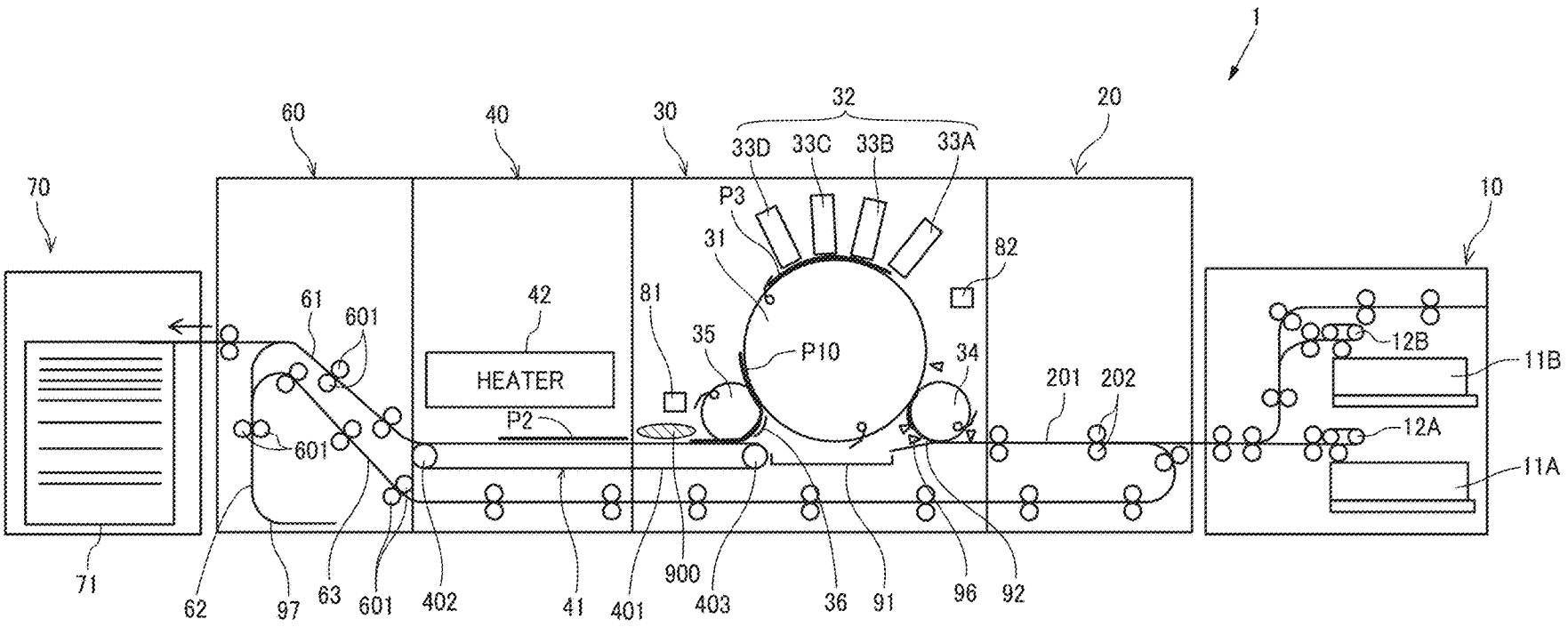
FIG. 6 is a diagram of a printing apparatus, illustrating how a sheet removing operation is performed, according to a control sample of the present disclosure.
Figure 7:
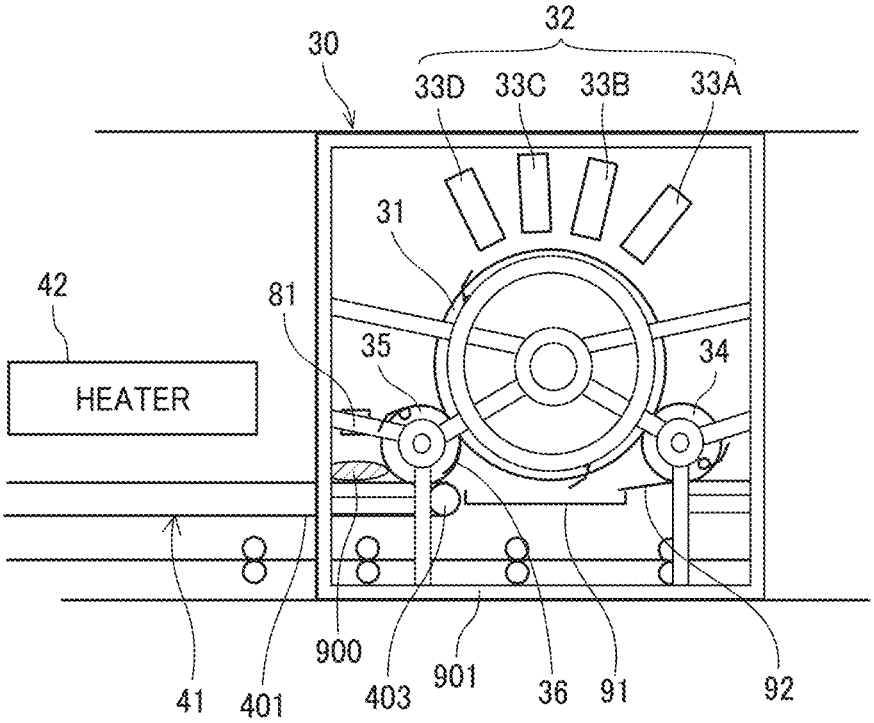
FIG. 7 is a diagram illustrating a frame structure of a printer in which frames of the printer are illustrated in an overlapping manner, according to the control sample of the present disclosure.

A control sample of the first embodiment of the present disclosure is described below with reference to FIGS. 6 and 7. FIG. 6 is a diagram of a printing apparatus 1 illustrating how a sheet removing operation is performed, according to the control sample. FIG. 7 is a diagram illustrating a frame structure of a printer 30 in which frames of the printer 30 are illustrated in an overlapping manner, according to the control sample.

In the control sample, as illustrated with the sheet P2 in FIG. 6, the sheet P2 that has remained stopped on the drum 31 is transferred to the drier 40 by the conveyor 41 to be removed by the inching operation.

However, even if the printing operation is stopped, the sheet P on the conveyance belt 401 is not removed from the drier 40 until the temperature of the heater 42 of the drier 40 is sufficiently lowered. For this reason, when the conveyance of the sheet P is stopped in the printing apparatus 1 due to a conveyance failure, a waiting time until the sheet P2 can be removed increases. Thus, productivity is lowered.

In this case, a portion of the conveyance belt 401 downstream from the exit rotator 35 is set as an ejection area 900, and the sheet P2 may be removed in the ejection area 900.

However, as illustrated in FIG. 7, a frame structure 901 of the printer 30 is disposed on a lateral side of the ejection area 900. Accordingly, a sufficient space for taking out the sheet P is not secured. For this reason, the workability of the removal operation of the sheet P2 deteriorates, and the downtime increases, resulting in a decrease in productivity.

On the contrary, in the present embodiment, the sheet P is conveyed by the conveyor 41 in the direction opposite to the direction in which the sheet P is ejected, and the sheet P is ejected to the purge tray 91 from which the sheet P can be easily removed to the outside of the printing apparatus 1. Accordingly, the sheet P that remains stopped in the printing apparatus 1 can be easily removed from the inside of the printing apparatus 1. Thus, a decrease in productivity can be reduced.

Figure 8:
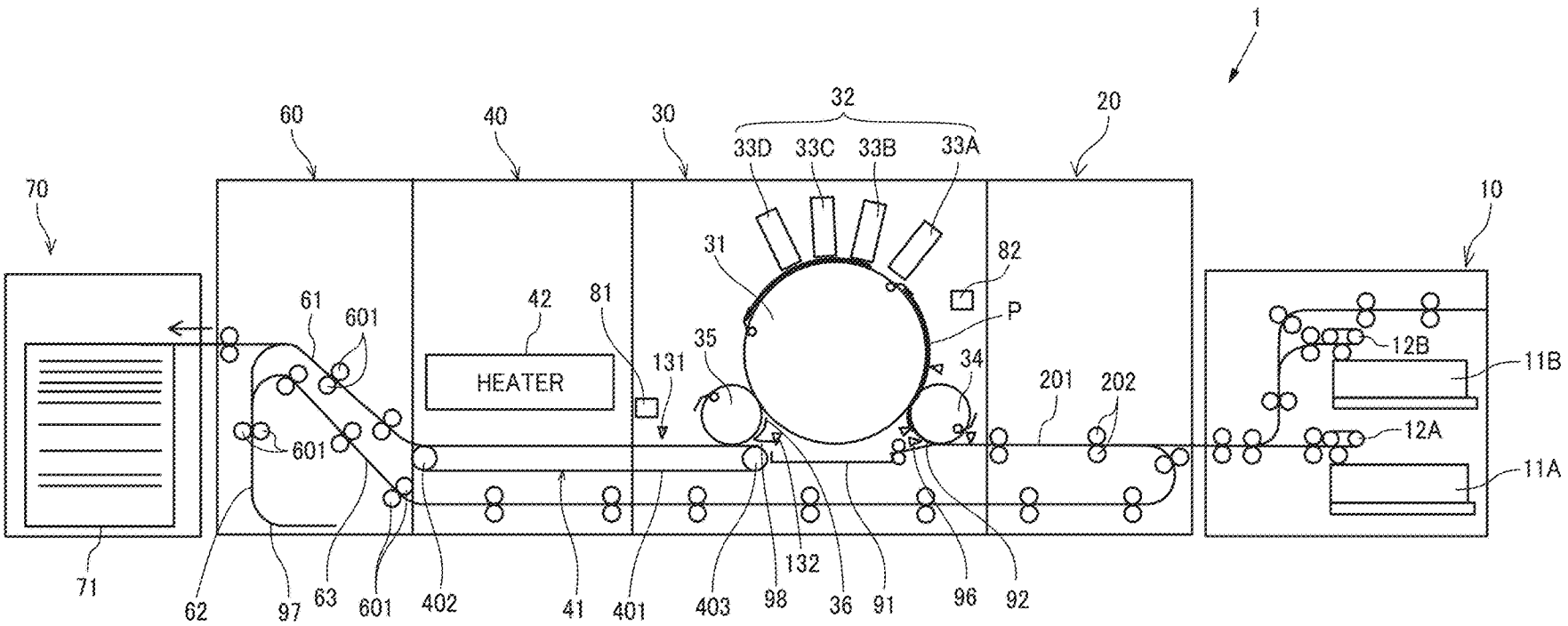
FIG. 8 is a schematic diagram illustrating a printing apparatus according to a second embodiment of the present disclosure.
Figure 9:
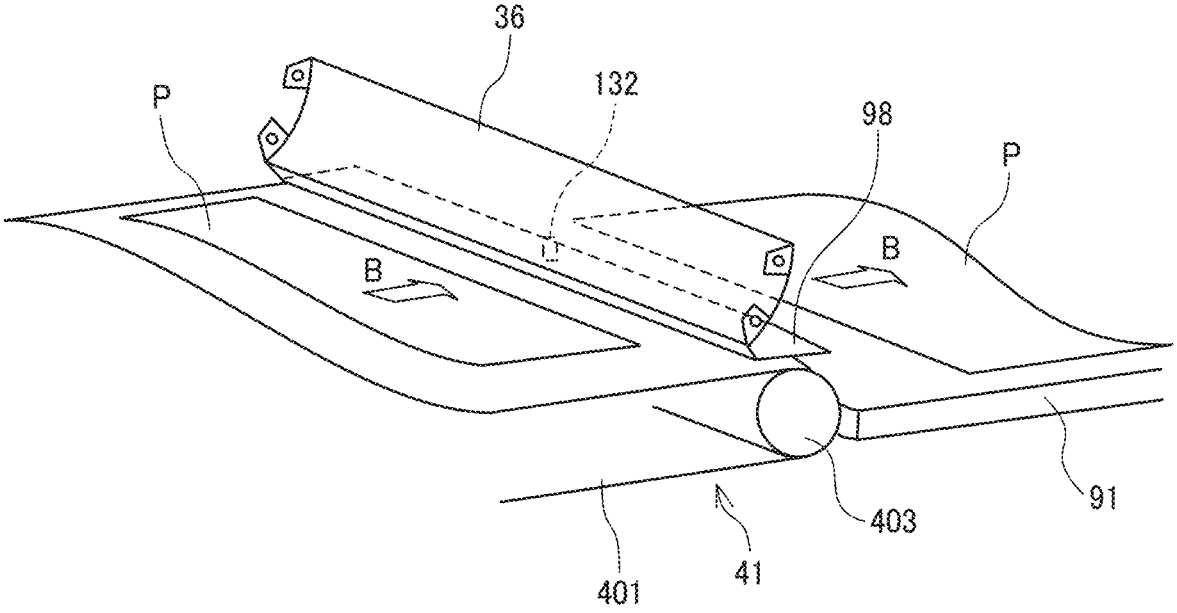
FIG. 9 is a perspective view of the vicinity of an exit rotator according to the second embodiment of the present disclosure.

Next, the printing apparatus 1 according to a second embodiment of the present disclosure is described with reference to FIGS. 8 and 9. FIG. 8 is a schematic diagram illustrating the printing apparatus 1 according to the second embodiment. FIG. 9 is a perspective view of the vicinity of the exit rotator 35 according to the second embodiment.

In the second embodiment, a third sensor 131 is disposed as a sheet detector that detects a sheet P on the conveyance belt 401 of the conveyor 41. The third sensor 131 is disposed between the drier 40 and a position at which the sheet P is delivered from the exit rotator 35 to the conveyance belt 401.

Further, a fourth sensor 132 as a sheet detector is disposed. The fourth sensor 132 detects the sheet P, conveyed in the direction indicated by arrow B opposite to the direction in which the sheet P is ejected, above the purge tray 91. In the second embodiment, the fourth sensor 132 is attached to the guide 98 as illustrated in FIG. 9.

Figure 10:
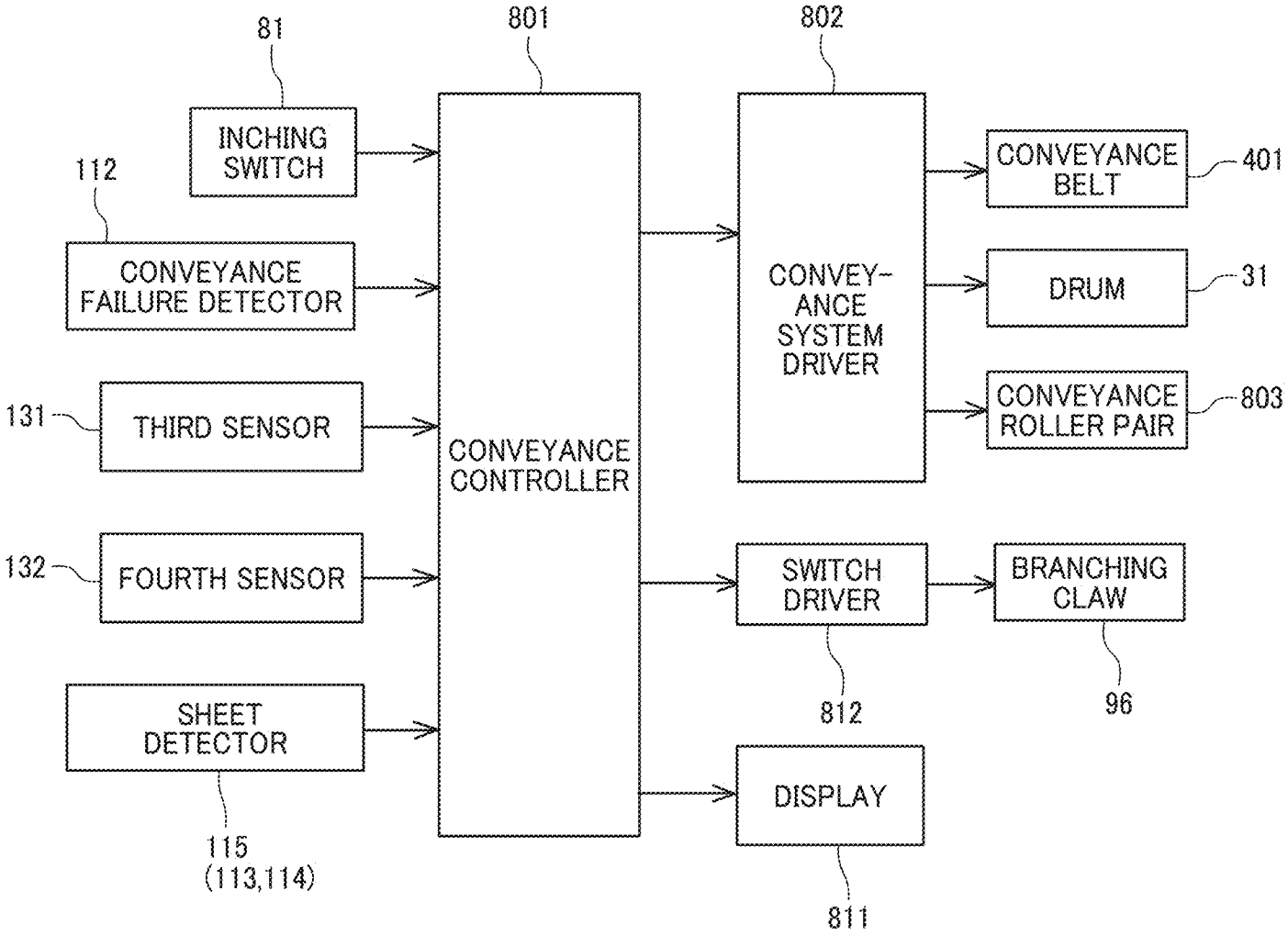
FIG. 10 is a block diagram illustrating components related to control of a sheet purge operation, according to the second embodiment of the present disclosure.

Next, control of the sheet purge operation according to the second embodiment is described with reference to a block diagram of FIG. 10.

In the second embodiment, the conveyance controller 801 receives detection results of the third sensor 131 and the fourth sensor 132 that serve as the sheet detectors. Based on the above detection results, the conveyance controller 801 controls the rotation and stop of the drum 31, and the movement and stop of the conveyance belt 401 and the switching of the movement direction, i.e., the rotation direction, of the conveyance belt 401 via the conveyance system driver 802.

Note that in the second embodiment, the belt reverse switch 83 of the first embodiment is not disposed. Other configurations of the second embodiment are the similar to the configurations of the first embodiment.

Figure 11A:
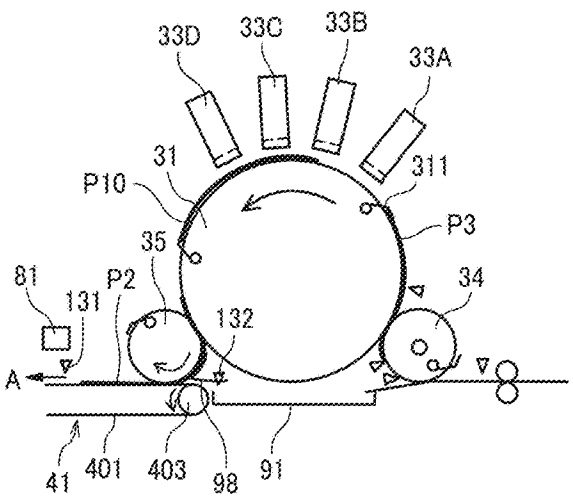
FIGS. 11A, 11B, and 11C are views of a drum and the periphery of the drum, illustrating an example of a procedure of removing sheets that remain stopped on the drum, according to the second embodiment of the present disclosure.
Figure 11B:
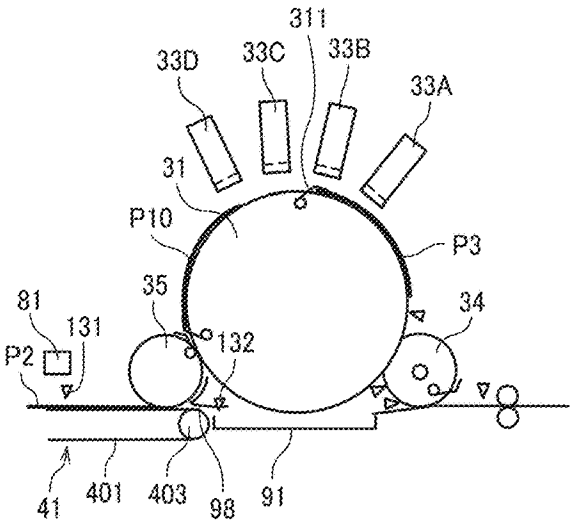
Figure 11C:
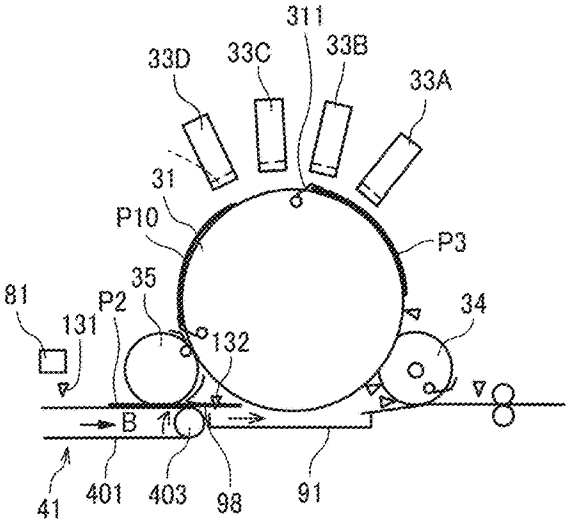

Next, an example of operation of removing the sheets P2, P10, and P3 that remain stopped on the drum 31, according to the second embodiment is described with reference to FIGS. 11A, 11B, and 11C. FIGS. 11A, 11B, and 11C are diagram illustrating how the sheets P2, P10, and P3 that remain stopped on the drum 31 are removed.

As illustrated in FIGS. 11A, 11B, and 11C, for example, when a conveyance failure is detected with the sheet P3 and conveyance of the sheets P2, P10, and P3 is stopped, the sheets P2, P10, and P3 remain stopped on the drum 31 in order from downstream to upstream in the conveyance direction.

First, as illustrated in FIG. 11A, when the inching switch 81 is pressed down, the drum 31 and the conveyance belt 401 of the conveyor 41 are driven to rotate in the forward direction, and the sheet P2 is conveyed toward the conveyance belt 401 of the conveyor 41.

Then, as illustrated in FIG. 11B, when a predetermined time elapses after the third sensor 131 detects the leading end of the sheet P2, the rotation driving of the drum 31 and the conveyance belt 401 of the conveyor 41 in the forward direction is stopped. In the second embodiment, the predetermined time is a time taken until the trailing end of the sheet P2 has been transferred onto the conveyance belt 401.

Next, as illustrated in FIG. 11C, the conveyance belt 401 of the conveyor 41 is rotated in the reverse direction to convey the sheet P2 to the purge tray 91. When the fourth sensor 132 detects the trailing end of the sheet P2, the driving of the conveyance belt 401 of the conveyor 41 is stopped.

An operation similar to the above-described operation is repeated for the sheets P10 and P3 to sequentially convey the sheets P10 and P3 that remain stopped on the drum 31 to the purge tray 91.

Accordingly, the sheets P2, P10, and P3 that remain stopped in the printing apparatus 1 can be transferred to the purge tray 91 from which the sheets P can be quickly removed to the outside of the printing apparatus 1. Thus, a decrease in productivity can be reduced.

Figure 12:
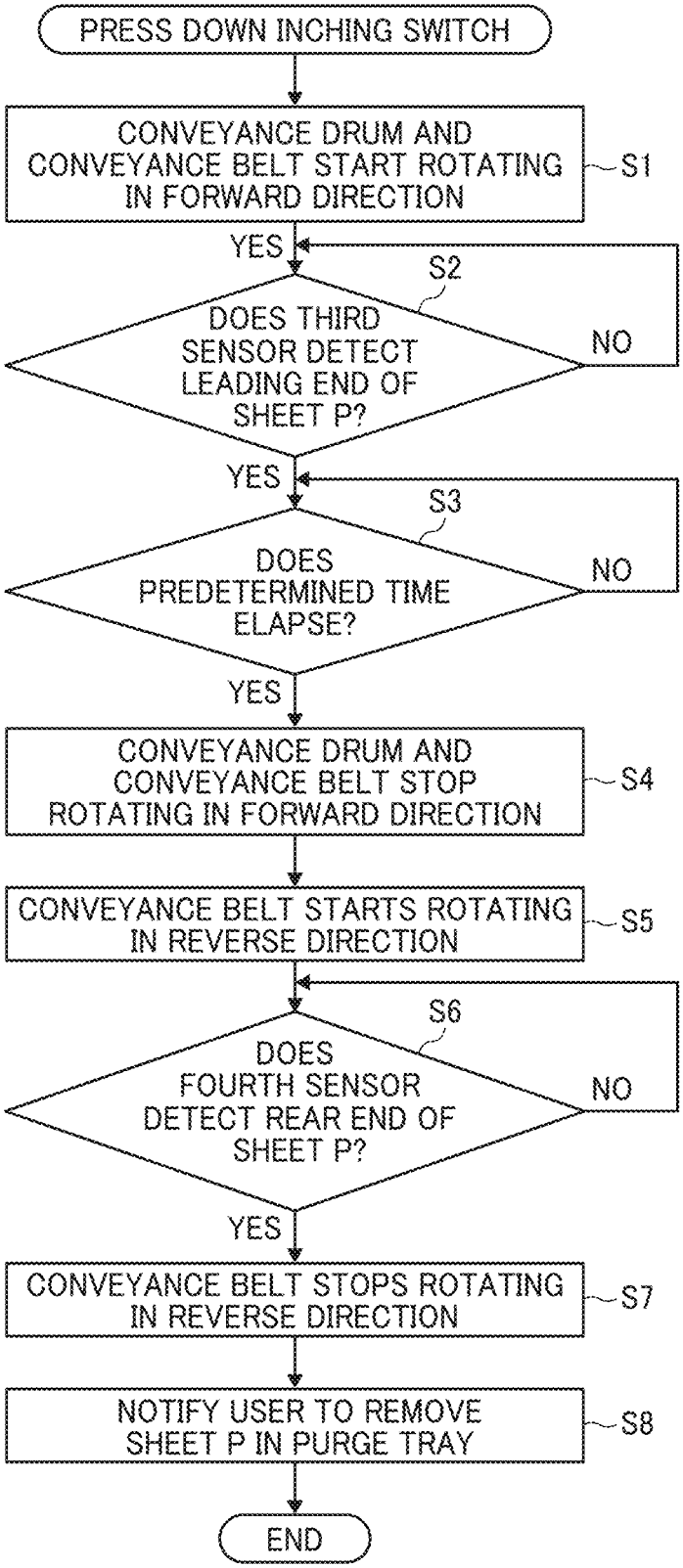
FIG. 12 is a flowchart illustrating a procedure of removal control performed by a conveyance controller when a sheet that remains stopped on the drum is removed, according to the second embodiment of the present disclosure.

Next, removal control performed by the conveyance controller 801 when the sheet P that remains stopped on the drum 31 is removed is described with reference to the flowchart of FIG. 12.

First, when the inching switch 81 is pressed down, the conveyance controller 801 starts the rotation driving of the drum 31 and the conveyance belt 401 of the conveyor 41 in the forward direction (step S1, referred to simply as S1 in the following description). Accordingly, the sheet P is conveyed toward the conveyance belt 401.

Subsequently, the conveyance controller 801 determines whether the third sensor 131 has detected the leading end of the sheet P (S2). When the third sensor 131 detects the leading end of the sheet P, the conveyance controller 801 determines whether the predetermined time has elapsed from the time when the third sensor 131 has detected the leading end of the sheet P (S3). As described above, the predetermined time is a time taken until the trailing end of the sheet P has been transferred onto the conveyance belt 401. Accordingly, the sheet P has been sufficiently transferred onto the conveyance belt 401 when the predetermined time elapses.

Accordingly, when the predetermined time elapses after the third sensor 131 detects the leading end of the sheet P, the conveyance controller 801 stops the rotation driving of the drum 31 and the conveyance belt 401 of the conveyor 41 in the forward direction (S4).

Subsequently, the conveyance controller 801 starts the rotation driving of the conveyance belt 401 in the reverse direction (S5). Thus, the sheet P on the conveyance belt 401 is conveyed toward the purge tray 91 in a direction opposite to the sheet ejection direction.

Accordingly, the conveyance controller 801 determines whether the fourth sensor 132 has detected the trailing end of the sheet P to be conveyed toward the purge tray 91 (S6). Then, when the fourth sensor 132 detects the trailing end of the sheet P to be conveyed toward the purge tray 91, the sheet P has been sufficiently transferred to the purge tray 91. Thus, the conveyance controller 801 stops the rotation driving of the conveyance belt 401 in the reverse direction (S7).

Subsequently, the conveyance controller 801 causes the display 811 to display a message to notify a user that the sheet P on the purge tray 91 needs to be removed (S8).

As described above in the second embodiment, the sheet P that remains stopped on the drum 31 can be automatically and quickly moved to the purge tray 91, and the removal operation of the sheet P can be facilitated compared to the first embodiment.

Figure 13:
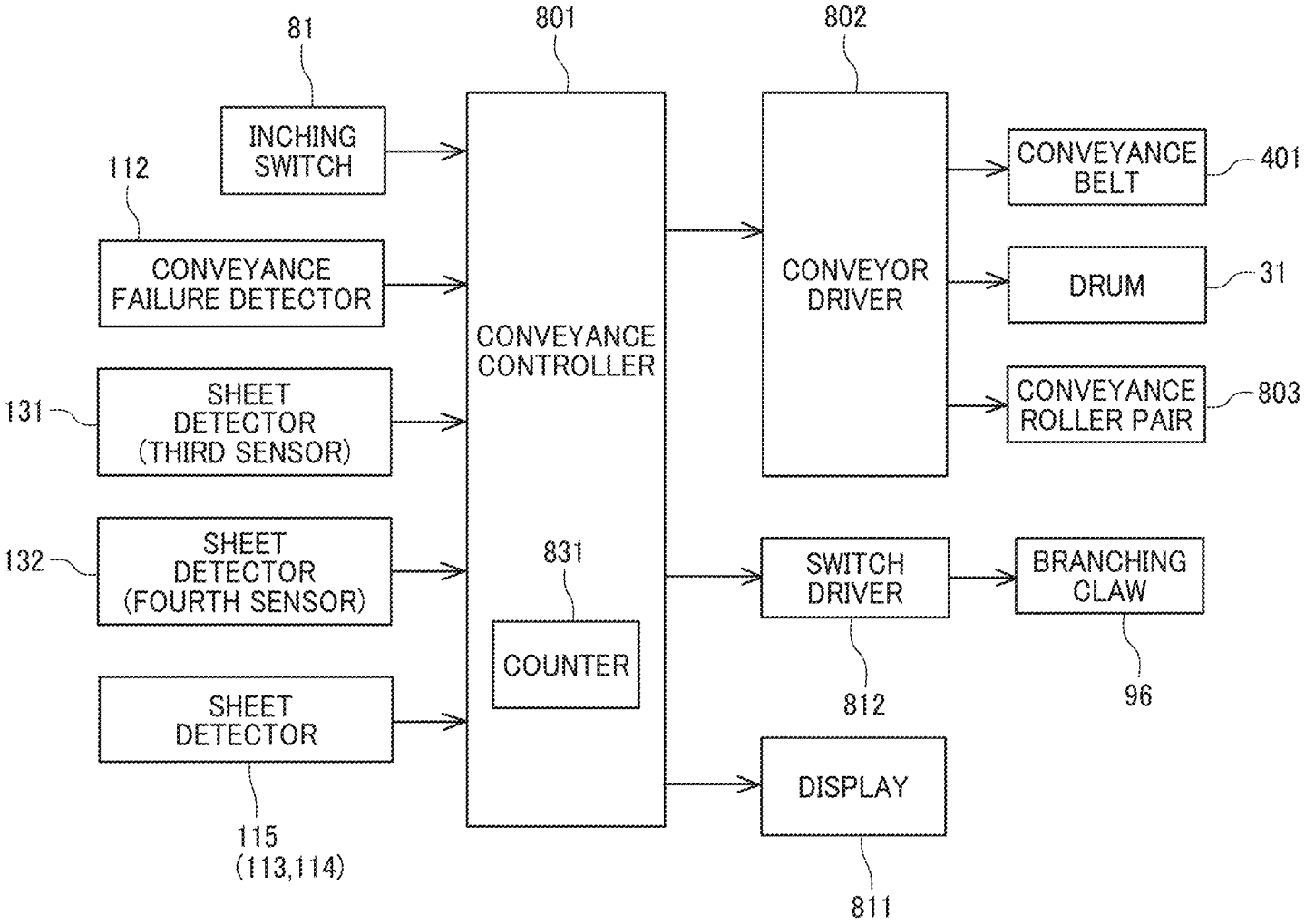
FIG. 13 is a block diagram illustrating components related to a control of a sheet purge operation according to a third embodiment of the present disclosure.

Next, the printing apparatus 1 according to a third embodiment of the present disclosure is described with reference to FIG. 13. FIG. 13 is a block diagram of control of the sheet purge operation of the printing apparatus 1, according to the third embodiment.

In the third embodiment, the conveyance controller 801 includes a counter 831 that counts the number of sheets P present on the drum 31. The counter 831 counts the number of the sheets P present on the drum 31 based on, for example, a count value of the number of sheets P detected by the first sensor 113 or the second sensor 114 and the number of sheets P that can be carried from the entrance rotator 34 to the exit rotator 35 of the drum 31. Other configurations of the third embodiment are similar to the configurations of the second embodiment.

Figures 14, 14A:
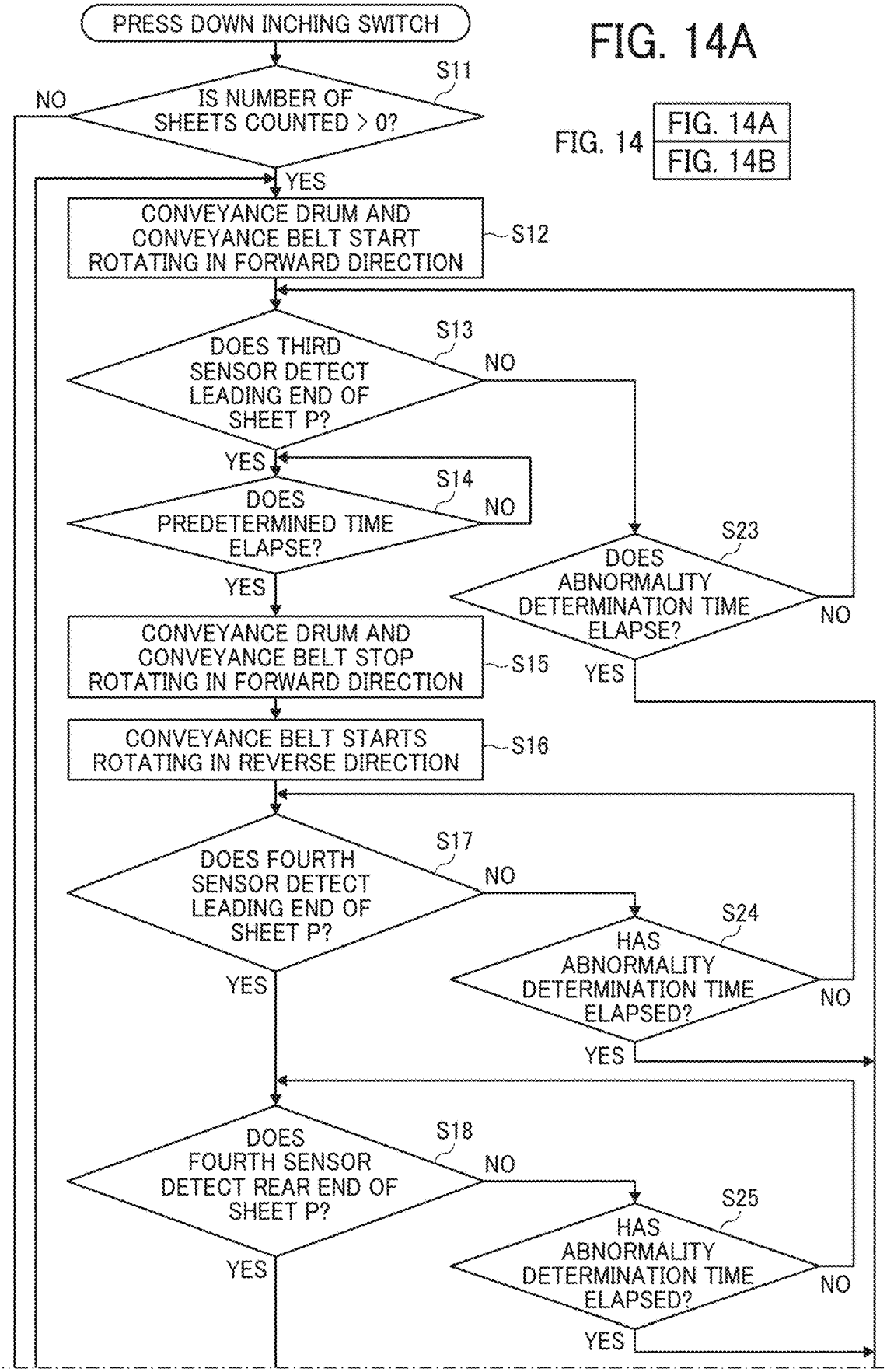
FIG. 14 including
FIGS. 14A and 14B is a flowchart illustrating a procedure of removal control performed by a conveyance controller when a sheet that remains stopped on the drum is removed, according to the third embodiment of the present disclosure.
Figure 14B:
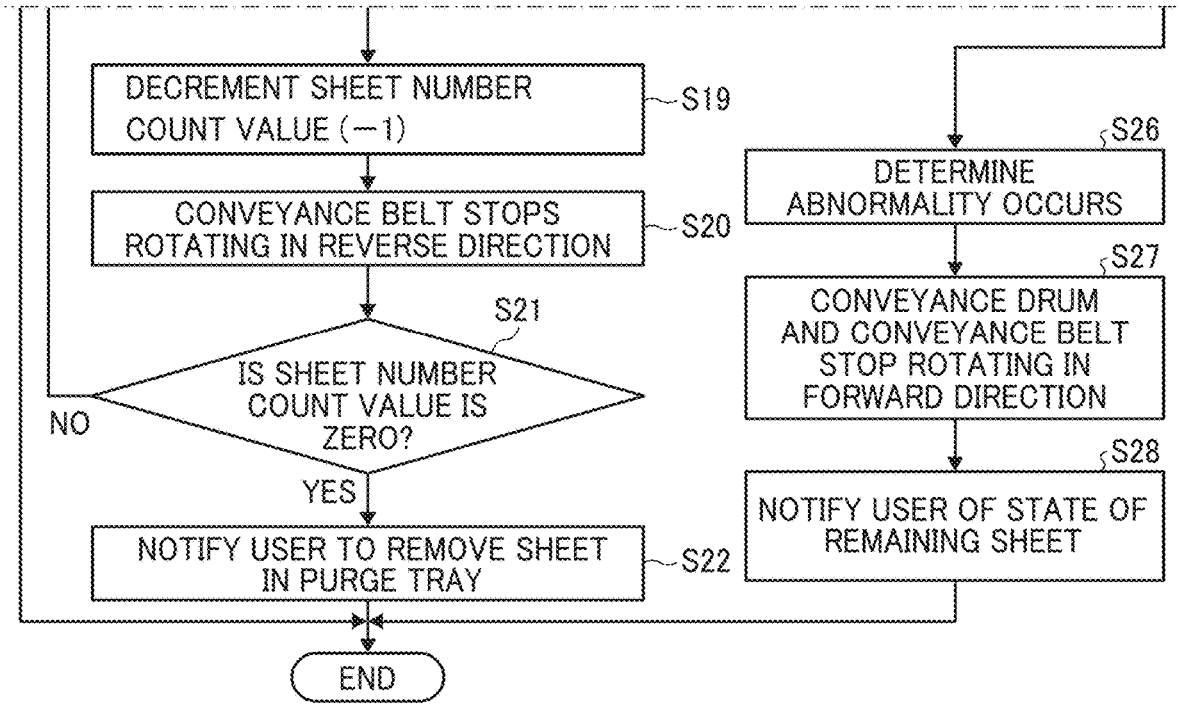

Next, the removal control performed by the conveyance controller 801 when the sheet P that remains stopped on the drum 31 is removed, is described with reference to the flowchart of FIG. 14.

First, when the inching switch 81 is pressed down, the conveyance controller 801 determines whether a count value of the number of sheets counted by the counter 831 is larger than zero (S11).

In the present embodiment, when the count value of the number of sheets counted by the counter 831 is larger than zero, the conveyance controller 801 starts rotation driving of the drum 31 and the conveyance belt 401 of the conveyor 41 in forward direction (S12). Accordingly, the sheet P is conveyed toward the conveyance belt 401.

Subsequently, the conveyance controller 801 determines whether the third sensor 131 has detected the leading end of the sheet P (S13). In the present embodiment, when the third sensor 131 detects the leading end of the sheet P, the conveyance controller 801 determines whether the predetermined time has elapsed from the time when the third sensor 131 detected the leading end of the sheet P (S14). As described above, the predetermined time is the time taken until the trailing end of the sheet P has been transferred onto the conveyance belt 401. Accordingly, the sheet P has been sufficiently transferred onto the conveyance belt 401 when the predetermined time elapses.

For this reason, when the predetermined time elapses after the third sensor 131 detects the leading end of the sheet P, the conveyance controller 801 stops the rotation driving of the drum 31 and the conveyance belt 401 of the conveyor 41 in the forward direction (S15).

Subsequently, the conveyance controller 801 starts the rotation driving of the conveyance belt 401 in the reverse direction (S16). Thus, the sheet P on the conveyance belt 401 is conveyed toward the purge tray 91 in the direction opposite to the sheet ejection direction.

Next, the conveyance controller 801 determines whether the fourth sensor 132 has detected the leading end of the sheet P to be conveyed toward the purge tray 91 (S17). In the present embodiment, when the fourth sensor 132 detects the leading end of the sheet P to be conveyed toward the purge tray 91, the conveyance controller 801 determines whether the fourth sensor 132 has detected the trailing end of the sheet P to be conveyed toward the purge tray 91 (S18).

When the fourth sensor 132 detects the trailing end of the sheet P to be conveyed toward the purge tray 91, the sheet P is transferred to the purge tray 91. Accordingly, after the conveyance controller 801 decrements (— 1) the count value of the number of sheets counted by the counter 831 (S19), the conveyance controller 801 stops the rotation driving of the conveyance belt 401 in reverse direction (S20).

Subsequently, the conveyance controller 801 determines whether the count value of the number of sheets counted by the counter 831 is larger than zero (S21). When the count value of the number of sheets counted by the counter 831 is larger than zero, the sheet P remains stopped on the drum 31. Accordingly, the conveyance controller 801 returns to step S12 and repeats the above-described processing.

When the count value of the number of sheets counted by the counter 831 is not larger than zero, in other words, when the count value of the number of sheets counted by the counter 831 is zero in step S21, all the sheets P that remain stopped on the drum 31 have been transferred to the purge tray 91. Accordingly, the conveyance controller 801 causes the display 811 to display a message to notify the user that the sheets P on the purge tray 91 need to be removed (S22).

Such a configuration as described above allows the sheets P that remain stopped on the drum 31 to be counted and all the sheets P to be automatically and quickly transferred to the purge tray 91. Accordingly, the sheet removal operation is facilitated compared to the first and second embodiments.

On the other hand, when the third sensor 131 does not detect the leading end of the sheet P in step S13, the conveyance controller 801 determines whether a predetermined first abnormality determination time has elapsed (S23). The first abnormality determination time is a time that elapses until the leading end of the sheet P is detected when the sheet P is normally conveyed by the rotation of the drum 31.

If the first abnormality determination time has not elapsed, the process returns to step S13. On the other hand, when the first abnormality determination time has elapsed without the third sensor 131 detecting the leading end of the sheet P, the conveyance controller 801 determines that an abnormality has occurred (S26).

In a similar manner, when the fourth sensor 132 does not detect the leading end of the sheet P in step S17, the conveyance controller 801 determines whether a predetermined second abnormality determination time has elapsed (S24). The second abnormality determination time is a time that elapses until the leading end of the sheet P is detected when the sheet P is normally conveyed in the reverse direction by the reverse rotation driving of the conveyance belt 401.

If the second abnormality determination time has not elapsed, the process returns to step S17. On the other hand, when the second abnormality determination time has elapsed without the fourth sensor 132 detecting the leading end of the sheet P, the conveyance controller 801 determines that an abnormality has occurred (S26).

Similarly, when the fourth sensor 132 does not detect the trailing end of the sheet P in step S18, the conveyance controller 801 determines whether a predetermined third abnormality determination time has elapsed (S25). The third abnormality determination time is a time that elapses from when the leading end of the sheet P has been detected until the trailing end of the sheet P is detected when the sheet P is normally conveyed in the reverse direction by the rotation driving of the conveyance belt 401 in the reverse direction.

If the third abnormality determination time has not elapsed, the process returns to step S18. On the other hand, when the third abnormality determination time has elapsed without the fourth sensor 132 detecting the trailing end of the sheet P, the conveyance controller 801 determines that an abnormality has occurred (S26).

When the conveyance controller 801 determines that the abnormality has occurred in step S26, the conveyance controller 801 stops driving the drum 31 or the conveyance belt 401 (S27), and notifies the user of a state of the remaining sheet P on the display 811 (S28).

Performing such an abnormality determination as described above can prevent the sheet P from being conveyed while a conveyance abnormality occurs.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. An image forming apparatus comprising:

an image forming device configured to form an image on a sheet;

a first conveyor on a first side of the image forming device and configured to convey the sheet in a first direction towards the image forming device;

a second conveyor on a second side of the image forming device and configured to convey the sheet in the first direction away the image forming device and convey the sheet in a second direction opposite the first direction;

processing circuitry configured to:

control conveyance of the sheet by the first and second conveyors, and control switching the second conveyor to convey the sheet in the second direction, after the conveyance of the sheet is stopped under a predetermined condition;

a storage configured to accommodate the sheet conveyed directly from the first conveyor in the first direction and accommodate the sheet conveyed directly from the second conveyor in the second direction;

a guide configured to guide the sheet conveyed from the secondconveyor to the storage, wherein the guide overlaps the image forming device and the second conveyor in a third direction perpendicular to the first and second directions.

2. The image forming apparatus according to claim 1, wherein the second conveyor is downstream from a rotating carrier that rotates while carrying the sheet, wherein the second conveyor includes a guiding member configured to guide the sheet delivered from the rotating carrier to the conveyor, and wherein the storage is disposed below the rotating carrier.

3. The image forming apparatus according to claim 2, wherein the guide is integrated with the guiding member.

4. The image forming apparatus according to claim 2, further comprising a detector configured to detect the sheet on the second conveyor, wherein the processing circuitry is configured to:

cause the rotating carrier and the second conveyor to stop movement of the sheet after a predetermined time elapses from detection of a leading end of the sheet; and control driving the conveyor after switching the direction in which the second conveyor conveys the sheet to the direction opposite to the direction in which the sheet is ejected.

5. The image forming apparatus according to claim 2, further comprising a counter configured to count a number of sheets borne on the rotating carrier.

6. The image forming apparatus according to claim 1, wherein the second conveyor includes a conveyance belt to rotate in a forward rotation direction and a reverse rotation direction, the forward rotation direction corresponding with the first direction, and the reverse rotation direction corresponding with the second direction.

7. The image forming apparatus according to claim 6, further comprising an instruction device configured to instruct rotation of the conveyance belt in the reverse rotation direction.

8. The image forming apparatus according to claim 1, further comprising a detector configured to detect the sheet conveyed in the direction opposite to the direction in which the sheet is ejected.

9. The image forming apparatus according to claim 1, wherein the second conveyor is configured to convey the sheet to the storage after a trailing end of the sheet has been transferred onto the second conveyor.

10. The image forming apparatus of claim 1, wherein the first conveyor includes an entrance claw, the entrance claw configured to selectively convey the sheet into the storage.

* * * * *